United States Patent [19]

Nielsen

[11] 4,399,658

[45] Aug. 23, 1983

[54] REFRIGERATION SYSTEM WITH CARBON DIOXIDE INJECTOR

[75] Inventor: Dean M. Nielsen, Castro Valley, Calif.

[73] Assignee: Safeway Stores, Incorporated, Oakland, Calif.

[21] Appl. No.: 876,178

[22] Filed: Feb. 8, 1978

[51] Int. Cl.[3] ..... F17C 7/02

[52] U.S. Cl. ..... 62/52; 62/197; 62/222; 62/388; 62/514

[58] Field of Search ..... 62/514 R, 197, 222, 62/388, 52

[56] References Cited

U.S. PATENT DOCUMENTS 3,063,258 11/1962 Szachnitowski ..... 62/309

3,109,296 11/1963 Williamson et al. ..... 62/514 R

*Primary Examiner*—Ronald C. Capossela

*Attorney, Agent, or Firm*—Flehr, Hohbach, Test, Albritton and Herbert

[57] ABSTRACT

A system for producing refrigeration from a source of liquid carbon dioxide. The liquid carbon dioxide is injected through a nozzle into a primary stream within an elongate enclosure. The enclosure is mounted with its inlet end spaced about the nozzle to define an opening through which an annular stream of ambient gas is directed about the primary stream. The ambient gas turbulently intermixes with the injected coolant for subliming any solid carbon dioxide or snow so that the resulting stream exhausting from the enclosure is free of snow.

14 Claims, 3 Drawing Figures

REFRIGERATION SYSTEM WITH CARBON DIOXIDE INJECTOR

REFERENCE TO RELATED APPLICATIONS

Reference is made to copending applications Ser. No. 818,503 filed July 25, 1977 and entitled Method and Apparatus For Producing Refrigeration, and to Ser. No. 838,204 filed Sept. 30, 1977 and entitled Process and System for Producing Refrigeration.

BACKGROUND OF THE INVENTION

This invention relates in general to refrigeration, and in particular relates to refrigeration systems employing liquified carbon dioxide as the coolant.

A number of refrigeration systems have heretofore been developed employing liquified carbon dioxide ($LCO_2$) to produce refrigeration. The $LCO_2$ typically is metered through a nozzle or snowhorn into a volume which is to be refrigerated. In another system the $LCO_2$ is injected through an air amplifier device of the type sold under the name Transvector and which is disclosed in the above-referenced applications Ser. Nos. 818,503 and 838,204.

Among the disadvantages and limitations of previous $LCO_2$ refrigeration systems is that injection of the coolant through a nozzle or snowhorn causes some of the liquid to flash to solid $CO_2$, known as dry ice or snow. The resulting plume of gas and snow is at a relatively cold temperature on the order of −110° F. so that it is difficult to control the temperature of the refrigerated volume. Also, deposit of the snow on certain food products can create localized freezing or "freezer-burn", which is highly objectionable from the standpoint of product degradation and spoilage. Certain systems have employed exhaust fans in an attempt to remove the snow and prevent the freezer-burn, but this has not been completely successful and moreover increases equipment and operating cost.

Typically $LCO_2$ refrigeration systems heretofore have required the use of a gas purge system to ensure that the nozzles or snowhorns do not become blocked by buildup of solid $CO_2$. The requirement of a gas supply and piping for the purge system increases the equipment and operating costs, and in addition is a source of malfunction and increases maintenance requirements.

Refrigeration systems employing Transvectors also have limitations and shortcomings. While the use of Transvectors for transforming the $LCO_2$ into a gas reduces the problem of dry ice buildup in certain cases, it is not completely successful with the result that over a period of time there can be an objectionable accumulation of dry ice in the refrigeration zone and on the product. In addition the Transvector devices employed in such systems are relatively complicated, bulky and expensive.

OBJECTS AND SUMMARY OF THE INVENTION

It is a general object of the invention to provide a new and improved carbon dioxide refrigeration system.

Another object is to provide a liquid carbon dioxide injector for a refrigeration system which is relatively simple in design and inexpensive in cost.

Another object is to provide a method and apparatus for producing refrigeration by injecting liquid carbon dioxide into a stream so that buildup of dry ice is minimized or eliminated, and in which the requirement for a gas purge system is obviated.

The invention in summary includes method and apparatus in which pressurized liquid carbon dioxide coolant is injected through a nozzle along a primary stream while the pressure is reduced to cause expansion of the liquid into a gas. The stream is directed through an open-ended hollow enclosure so that an annular stream of ambient gas is drawn into the enclosure about the primary stream. The ambient gas turbulently intermixes with the primary stream so that solid carbon dioxide is sublimed into a gas. The mixture of coolant and ambient gas is discharged through the outlet of the enclosure to produce refrigeration.

DESCRIPTION OF THE PREFERRED EMBODIMENTS

Figure 1:
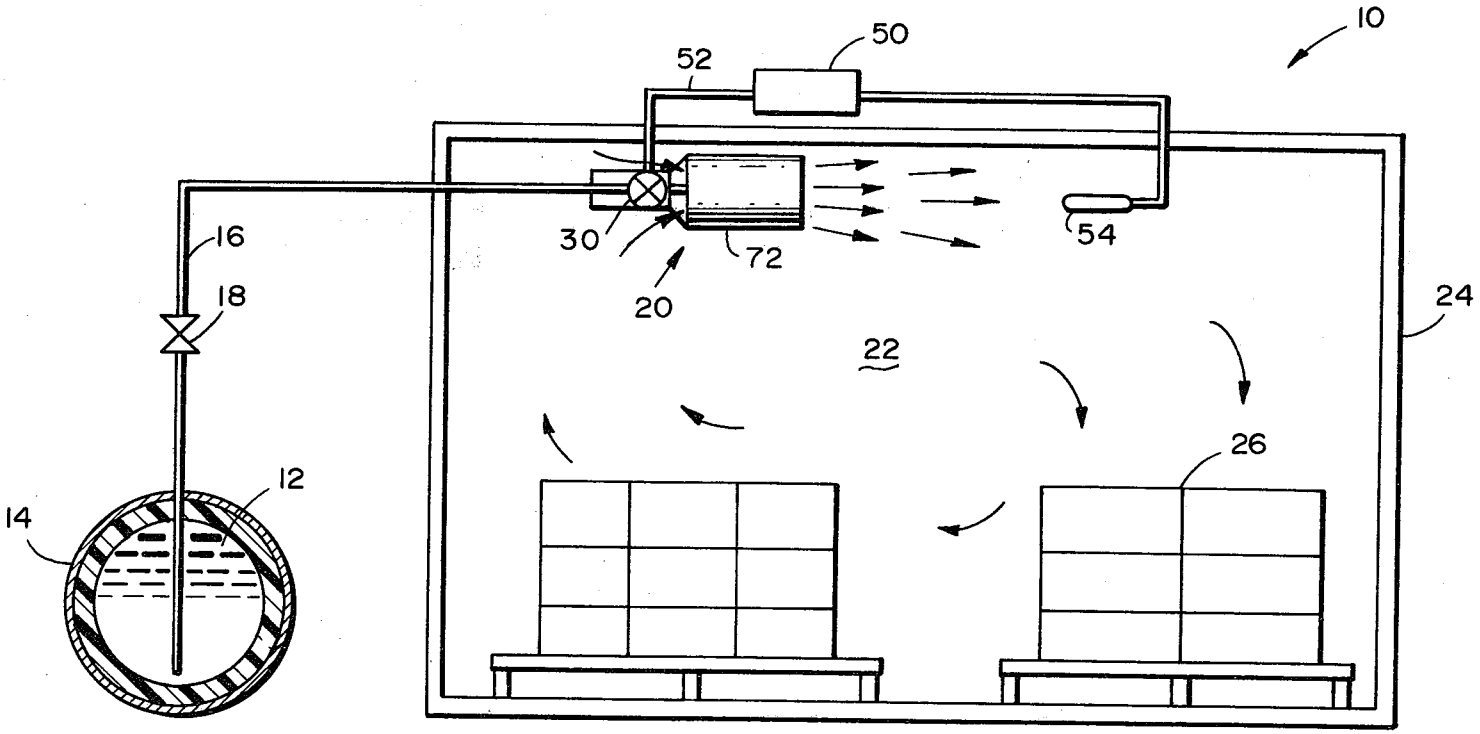
FIG. 1 is a schematic diagram of a refrigeration system according to the invention.

In the drawings FIG. 1 illustrates generally at 10 a system for producing refrigeration with liquified carbon dioxide. A source of liquified carbon dioxide 12 is stored within an insulated pressure tank 14 at the desired temperature and pressure levels. A supply pipe 16 and on-off valve 18 direct liquid coolant from the tank to injector apparatus 20 provided within refrigeration zone 22. The refrigeration zone is enclosed by the walls of a compartment 24, which in the illustrated embodiment is shown as a refrigerated room containing a typical food product 26. The refrigeration zone could also be within a mobile reefer trailer, freezer tunnel or the like.

Figure 2:
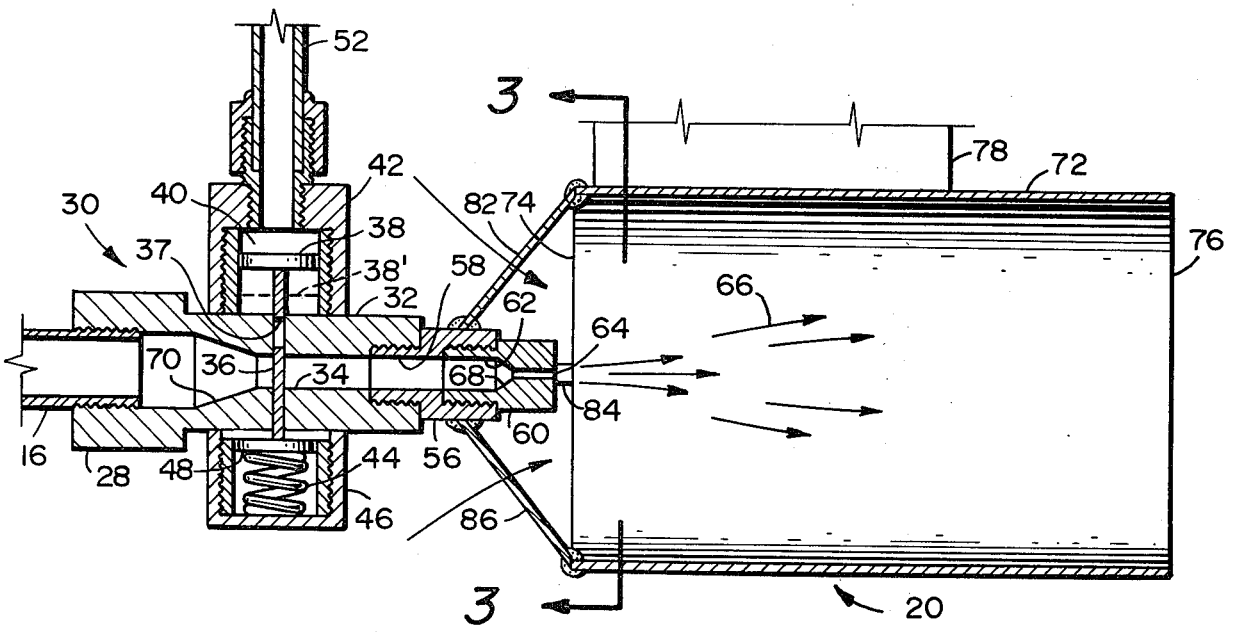
FIG. 2 is a vertical section view of the liquid carbon dioxide injector apparatus which is a component of the system of FIG. 1.
Figure 3:
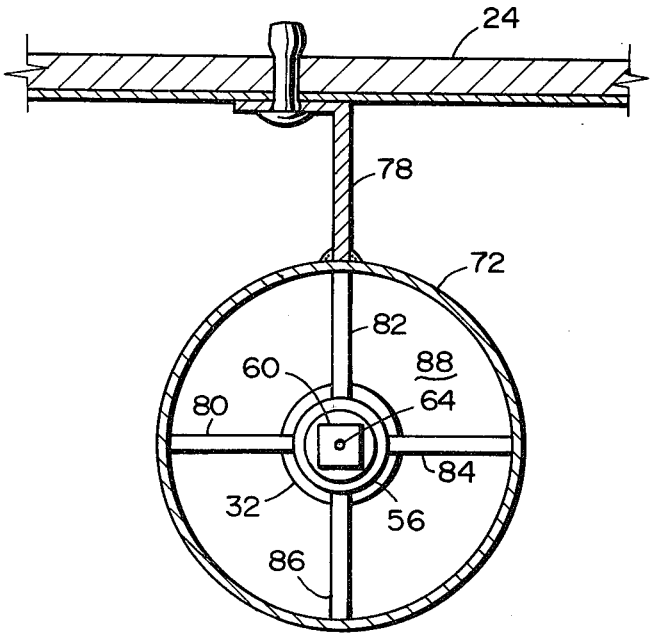
FIG. 3 is a cross-sectional view taken along the line 3—3 of FIG. 2.

Referring to FIGS. 2 and 3 injector apparatus 20 is illustrated in greater detail. The outlet end of $LCO_2$ supply pipe 16 is threaded into the inlet 28 of a metering valve 30. Metering valve 30 comprises a body 32 formed with a flow passage or channel 34 across which a valve plate 36 is mounted for vertical sliding movement. The valve plate is formed with an aperture 37 which is moved down by the plate into register with the channel for metering $LCO_2$ flow. A piston 38 mounted at the upper end of the plate is slidable within a chamber 40 formed by a cylinder 42 mounted above the valve body. A compression spring 44 carried within a housing 46 mounted below the valve body seats against a plate 48 which is attached to the lower end of the valve plate.

A pneumatic control system is provided for operating valve 30, and the control system includes a suitable temperature controller 50 which delivers a gas pressure signal through piping 52 into chamber 40 responsive to a temperature signal received from a capillary-type sensor 54 mounted within compartment 22. The gas source for the pneumatic signal in the controller can be provided from a suitable pressure-builder coil and/or a line, not shown, leading from $LCO_2$ tank 14. Conventional means is provided in controller 50 for regulating the gas pressure signal in piping 52 when a temperature above or below a pre-set level is sensed within the compartment. A buildup of the pressure signal within chamber 40 urges piston 38 toward the position indicated at 38' so that the valve plate is moved down against the force of spring 44 to carry valve aperture 37 into alignment with flow passage 34 for metering coolant through the valve.

A nozzle 56 is threadably mounted at the end of valve body 32. A central bore 58 in the nozzle forms a continuation of the flow channel 34. A replaceable nozzle tip 60 is threadably mounted in the distal end of the nozzle. The tip is also formed with a center bore 62 as a continuation of the flow channel. A circular orifice 64 in the tip communicates with the flow channel for injecting the coolant into an outwardly diverging primary stream 66. The bore or flow channel in the tip 60 is formed with a frusto-conical end wall 68 which converges toward and merges with orifice 64. The frusto-conical shape of end wall 68 serves to prevent buildup of solid coolant within the tip because the flow of coolant in the passage will carry along and expel any solid coolant along the converging end wall and through the orifice. This configuration is particularly effective to prevent blockage due to solid coolant which may build up when the injector is shut down. Immediately upstream of valve plate 36 another forwardly converging frusto-conical wall 70 is formed in the flow channel of valve body 32. The configuration of this wall also serves to prevent blockage due to buildup of solid coolant in a manner similar to that explained for tip end wall 68.

An elongate hollow enclosure 72 is positioned coaxially about primary stream 66 immediately downstream of the injector tip. The enclosure comprises a cylindrical shell having a circular inlet 74 and circular outlet 76. The shell is carried below the compartment ceiling by means of a bracket 78. A plurality of circumferentially spaced struts 80–86 are secured at their inner ends about injector 56 and diverge outwardly for connection at their outer ends to inlet 74 of the enclosure.

Enclosure inlet 74 is radially spaced about nozzle tip 60 so as to define an annular opening 88 (FIG. 3) through which an annular stream of ambient gas or air from within compartment 22 is drawn or entrained by primary stream 66. The size and positioning of the enclosure inlet is predetermined with respect to the size and positioning of nozzle orifice 64 to achieve an optimum relationship between the volume of entrained ambient gas and the volume of injected coolant. The predetermined relationship between the inlet and the nozzle is established so that the primary stream is injected in a pattern which diverges outwardly from the orifice in a direction which intersects the annular stream of ambient gas so that the intersecting streams cause optimum mixing of gas and coolant. This mixing causes substantially all solid coolant or dry ice in the primary stream to sublime into a gas by ensuring that a sufficient volume of relatively warmer ambient gas contacts the coolant solids in the primary stream. The turbulent intermixing is also enhanced due to the positioning of struts 80–86 which act as spoilers in the path of the ambient gas stream.

The preferred relationship between the enclosure inlet and nozzle orifice which produces the results described above are achieved in the invention by a configuration in which the annular opening cross-sectional area has a large ratio to the cross-sectional area of the nozzle opening, preferably on the order of 300:1 or greater. As an example, one specific configuration which has been found suitable for this purpose comprises a nozzle tip diameter of $\frac{1}{2}''$ and an enclosure inlet diameter of $2\frac{1}{2}''$ so that the annular opening 88 has a cross-sectional area of 4.72 $in^2$. Also in this example the nozzle orifice has a diameter of $\frac{1}{8}''$ with a resulting cross-sectional area of 0.0123 $in^2$ so that the area ratio is substantially 380:1.

The desired interaction between the primary coolant stream and surrounding ambient gas stream is enhanced in the invention by locating enclosure inlet 74 so that it lies in a plane substantially perpendicular to the direction of the primary stream and with the nozzle orifice positioned substantially adjacent such plane. The example illustrated in the embodiment of FIG. 2 provides for the nozzle orifice being spaced upstream of the plane of the inlet opening substantially $\frac{1}{8}''$. This permits the stream of ambient gas to completely surround the injector tip to optimize entrainment with the primary stream.

The use and operation of the invention will be described in connection with the following example. A supply of liquid carbon dioxide at a temperature of −10° F. and a pressure of 275 psig is loaded within tank 14. Where the product 26 to be refrigerated within the compartment comprises a food such as meat and milk, controller 50 is set at a temperature of 38° F. Valve 18 is turned on and the controller senses a low temperature condition within the compartment by means of bulb 54. The controller directs a pneumatic signal through piping 52 into chamber 40 and the pneumatic pressure acts against piston 38 to move valve plate 36 down. As valve aperture 37 moves across flow channel $LCO_2$ coolant is metered through the valve and injected out through nozzle orifice 64, with any dry ice lodged within the channel being swept out by the flow of coolant. The coolant is injected from the orifice in an outwardly diverging primary stream 66 concentric with enclosure 72. The injected coolant undergoes a rapid drop in pressure as it expands into a gas. The concomitant cooling effect causes formation of some solid $CO_2$ which is carried in the stream. The relatively high velocity primary stream causes entrainment of ambient gas surrounding the injector tip. A large volume of the entrained ambient gas flows in an annular stream through the enclosure inlet about and intersecting with the primary stream. Turbulent intermixing is created by the intersecting streams as well as by the spoiler effect of the struts. The thermal energy of the relatively warmer ambient gas causes dry ice in the primary stream to rapidly sublime into a gas. The mixture of ambient gas and expanded coolant continues along the enclosure and discharges from outlet 76 to produce refrigeration within compartment 24. The force of the discharging gas together with the suction effect of the ambient gas entrained into the injector causes return circulation of the gas through the compartment and around the food products so that uniform cooling is established throughout the compartment without the need for circulating fans or blowers. When the compartment temperature drops below the level pre-set in the controller, bulb 54 triggers the controller to reduce the penumatic signal in piping 52 so that valve plate 36 is urged upwardly by spring 44 to reduce the flow of coolant being injected.

The invention makes it possible to modify the injector for use in varying refrigeration applications or for calibration purposes. The injector can be modified by unscrewing nozzle tip 60 and replacing it with another tip having an orifice of greater or lesser size so that a greater or lesser cooling rate is produced. Replacement of the nozzle tip can be easily accomplished in the field without disassembling the entire injector.

From the foregoing it is apparent that there has been provided herein a refrigeration system which provides important advantages and results over existing systems. The $LCO_2$ injector is of relatively simple design and is inexpensive to manufacture, assembly and calibrate, especially as compared to systems employing the previously described air amplifier devices. The system produces a refrigerating stream of coolant which is substantially free of dry ice, which otherwise could produce undesirable results such as freezer-burn on certain food products. The injector acts in a manner which enhances interaction between the streams of injected coolant and ambient gas, and turbulent intermixing of the streams is induced. The straight-through flow channel of the injector and the frusto-conical walls in the channel act in a manner to expel solid coolant and minimize blockage of the injector, thereby eliminating the requirement for a gas purge system.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A method for producing refrigeration from a source of pressurized liquid carbon dioxide coolant, comprising the steps of injecting coolant from the source through a nozzle orifice into a primary stream of solid cross-section while reducing the pressure of coolant entering the stream to cause such coolant to substantially expand into a gas, directing the primary stream of coolant lengthwise through an elongate cylindrical enclosure having an inlet end completely open to ambient gas and an outlet end completely open to a zone to be refrigerated and including strut means mounted between the enclosure inlet end and nozzle and lying in the path of ambient gas for creating turbulence therein, directing ambient gas in an annular stream which concentrically encloses the primary stream of coolant and in the same direction thereof through the inlet end into the enclosure, mixing ambient gas from the annular stream with coolant in the primary stream in an amount to sublime substantially the entirety of solid coolant therein into a gas, and directing the mixture of ambient gas and coolant from the outlet end of the enclosure into the zone to produce refrigeration.

2. A method as in claim 1 in which the ambient gas is entrained through the inlet end in turbulent flow with the turbulent flow interacting with the primary stream to produce said mixing with the ambient gas.

3. A method as claim 1 in which the primary stream is injected to a pattern which diverges outwardly from the orifice in a direction intersecting the annular stream with the intersecting streams causing mixing of the ambient gas and coolant.

4. An injector for use in a system for producing refrigeration in a zone from a source of pressurized liquid carbon dioxide coolant, the injector comprising the combination of a nozzle having an outlet opening of solid cross-section for injecting coolant from the source along a stream concomitant with reduction of pressure of the coolant to cause it to substantially expand into a gas, a hollow cylindrical enclosure defining an elongate passage, said enclosure having an inlet end which completely opens from ambient gas into the passage and an outlet end which opens from the passage into the refrigeration zone, strut means mounted between the enclosure inlet end and nozzle and lying in the path of ambient gas for creating turbulence therein, means for mounting the enclosure at a position where the stream is directed lengthwise through the passage and with the inlet end spaced about the nozzle to define an annular opening through which gas is drawn along a path concentrically about the stream of injected coolant for mixing therewith in an amount to sublime substantially the entirety of solid coolant therein into a gas, with the mixture of coolant and ambient gas thereafter discharging through the outlet end into the zone to produce refrigeration.

5. An injector as in claim 4 in which the enclosure comprises a cylindrical shell concentric with the injected stream.

6. An injector as in claim 5 in which the inlet end of the enclosure is circular and is mounted concentric about the nozzle to define a circular opening through which ambient gas is drawn.

7. An injector as in claim 4 in which the spacing of the inlet end about the nozzle defines an annular opening with a cross-sectional area having a ratio to the cross-sectional area of the nozzle opening of 380:1 or greater so that the rate of ambient gas drawn through the annular opening is sufficiently greater than the rate of coolant being injected to sublime substantially all solid coolant which may be formed in the stream.

8. An injector as in claim 4 in which the enclosure is mounted with its inlet opening lying in a plane substantially perpendicular to the direction of the injected stream, and with the nozzle opening positioned substantially adjacent the said plane whereby ambient gas encloses the nozzle.

9. An injector as in claim 8 in which the nozzle opening is spaced upstream of the plane of the inlet opening substantially $\frac{1}{8}''$.

10. An injector as in claim 4 in which the nozzle includes means forming a longitudinally extending flow channel for directing pressurized coolant to the nozzle opening, with the longitudinal axis of the channel being aligned through the nozzle opening to provide a straight-through flow of coolant from the channel through the nozzle opening into the stream.

11. An injector as in claim 4 in which the nozzle includes means forming a flow channel for directing pressurized coolant in a direction longitudinally of the nozzle to the nozzle opening, said channel having a frusto-conical end wall which converges toward the nozzle opening so as to expell through such opening any solid coolant that may build up in the channel.

12. An injector as in claim 4 in which the nozzle includes a detachably mounted tip having an orifice of predetermined size which defines said outlet opening.

13. A system for producing refrigeration including a source of pressurized liquid carbon dioxide coolant, an injector assembly including a nozzle connected with the coolant source, said nozzle having an injector orifice of solid cross-section and of a size which maintains coolant within the nozzle in a liquid state while injecting coolant into a stream with concomitant reduction in pressure to expand the injected coolant into a gas, an elongate hollow cylindrical enclosure mounted about the path of the injected stream, said enclosure having an inlet end radially spaced about the nozzle orifice to define an annular opening through which ambient gas is drawn by and concentrically about the stream into the enclosure for mixing with the coolant in the stream in an amount which sublimes substantially the entirety of solid $CO_2$ in the stream into a gas, strut means mounted between the enclosure inlet end and nozzle and lying in the path of ambient gas for creating turbulence therein, said enclosure having an open outlet end through which the mixture of ambient gas and coolant is directed to produce refrigeration.

14. A system as in claim 12 which includes valve means mounted upstream of the nozzle orifice for controlling the flow of coolant from the source to the nozzle orifice whereby the amount of refrigeration is controlled.

* * * * *